US011214921B2

(12) United States Patent
Hall

(10) Patent No.: US 11,214,921 B2
(45) Date of Patent: Jan. 4, 2022

(54) SYSTEM AND METHOD FOR FORMATION OF WOVEN STYLE TUFTED CUT/LOOP FABRICS

(71) Applicant: Card-Monroe Corp., Chattanooga, TN (US)

(72) Inventor: Wilton Hall, Ringgold, GA (US)

(73) Assignee: Card-Monroe Corp., Chattanooga, TN (US)

( * ) Notice: Subject to any disclaimer, the term of this patent is extended or adjusted under 35 U.S.C. 154(b) by 109 days.

(21) Appl. No.: 16/841,783

(22) Filed: Apr. 7, 2020

(65) Prior Publication Data

US 2020/0232158 A1 Jul. 23, 2020

Related U.S. Application Data

(63) Continuation of application No. 15/897,396, filed on Feb. 15, 2018, now Pat. No. 10,626,551, which is a (Continued)

(51) Int. Cl.
*D06N 7/00* (2006.01)
*D05C 15/10* (2006.01)

(Continued)

(52) U.S. Cl.
CPC ..... *D06N 7/0065* (2013.01); *D05C 15/10* (2013.01); *D05C 15/12* (2013.01); *D05C 15/18* (2013.01);

(Continued)

(58) Field of Classification Search
CPC .. D06N 7/00; D06N 7/0065; D05C 15/00–36; D05C 17/02; D05C 17/026; Y10T 428/23957
See application file for complete search history.

(56) References Cited

U.S. PATENT DOCUMENTS

D96,477 S * 8/1935 Jacobsen ..... D05B 71/00 112/280
2,950,741 A * 8/1960 Janney ..... D03D 39/00 139/39

(Continued)

FOREIGN PATENT DOCUMENTS

GB 859761 1/1961
GB 2 255 785 11/1992

(Continued)

OTHER PUBLICATIONS

International Search Report and Written Opinion for related PCT application No. PCT/US2014/068828, dated Mar. 31, 2015.

*Primary Examiner* — Ismael Izaguirre
(74) *Attorney, Agent, or Firm* — Womble Bond Dickinson (US) LLP

(57) ABSTRACT

A system and method for forming patterned tufted fabrics such as carpets, including the formation of patterns having cut pile and loop pile tufts therein. The system includes a pair of needle bars each carrying a series of needles to which a plurality of yarns are fed. Cut pile hooks are arranged along a cut pile side of a tufting zone, in a position to engage the needles of one of the needle bars, while loop pile loopers are arranged along the opposite loop pile side of the tufting zone, in a position to engage the needles of the other one of the needle bars. A backing material is fed through the tufting zone, and as loop pile tufts of yarns are formed in the backing material, the needles mounted along a needle bar extending along the cut pile side of the tufting zone can be shifted to an off-gauge position, with the yarn feed to these needles further being controlled, to substantially prevent engagement and pick-up of the yarns carried by such needles by the cut pile hooks.

15 Claims, 5 Drawing Sheets

Related U.S. Application Data continuation of application No. 14/560,505, filed on Dec. 4, 2014, now Pat. No. 9,909,254.

(60) Provisional application No. 61/912,209, filed on Dec. 5, 2013.

(51) Int. Cl.

| | |
|---|---|
| ***D05C 15/12*** | (2006.01) |
| ***D05C 15/18*** | (2006.01) |
| ***D05C 15/30*** | (2006.01) |
| ***D05C 15/36*** | (2006.01) |
| ***D05C 17/02*** | (2006.01) |

(52) U.S. Cl.

CPC ..... *D05C 15/30* (2013.01); *D05C 15/36* (2013.01); *D05C 17/02* (2013.01); *D05C 17/026* (2013.01); *D06N 7/00* (2013.01); *Y10T 428/23957* (2015.04)

(56) References Cited

U.S. PATENT DOCUMENTS

| | | | | |
|---|---|---|---|---|
| 3,443,534 | A | | 5/1969 | Lund |
| 4,015,036 | A | * | 3/1977 | Haemer ..... D04H 11/00 428/88 |
| 4,067,270 | A | | 1/1978 | Short |
| 4,158,339 | A | | 6/1979 | Short |
| 4,366,761 | A | | 1/1983 | Card |
| 4,429,648 | A | | 2/1984 | Slattery |
| 4,440,102 | A | | 4/1984 | Card et al. |
| 4,501,212 | A | | 2/1985 | Slattery |
| 4,503,787 | A | | 3/1985 | Watkins |
| 4,519,326 | A | | 5/1985 | Green et al. |
| 4,549,496 | A | | 10/1985 | Kile |
| 4,619,212 | A | | 10/1986 | Card et al. |
| 4,630,558 | A | | 12/1986 | Card et al. |
| 4,754,718 | A | | 7/1988 | Watkins |
| 4,800,828 | A | | 1/1989 | Watkins |
| 4,815,403 | A | | 3/1989 | Card et al. |
| 4,820,566 | A | | 4/1989 | Heine |
| 4,836,118 | A | | 6/1989 | Card et al. |
| 4,867,080 | A | | 9/1989 | Taylor et al. |
| 4,903,624 | A | | 2/1990 | Card et al. |
| 4,903,625 | A | | 2/1990 | Card et al. |
| 4,981,091 | A | | 1/1991 | Taylor et al. |
| 5,005,498 | A | | 4/1991 | Taylor et al. |
| 5,058,518 | A | | 10/1991 | Card et al. |
| 5,193,472 | A | | 3/1993 | Crossley |
| 5,224,434 | A | | 7/1993 | Card et al. |
| 5,383,415 | A | | 1/1995 | Padgett, III |
| 5,392,723 | A | | 2/1995 | Kaju |
| 5,461,996 | A | | 10/1995 | Kaju |
| 5,526,760 | A | | 6/1996 | Ok |
| 5,544,605 | A | | 8/1996 | Frost |
| 5,549,064 | A | | 8/1996 | Padgett, III |
| 5,560,307 | A | | 10/1996 | Padgett, III |
| 5,566,630 | A | | 10/1996 | Burgess et al. |
| 5,575,228 | A | | 11/1996 | Padgett, III et al. |
| 5,588,383 | A | | 12/1996 | Davis et al. |
| 5,622,126 | A | | 4/1997 | Card et al. |
| 5,653,184 | A | * | 8/1997 | Bardsley ..... D05B 71/00 112/280 |
| 5,706,744 | A | | 1/1998 | Card et al. |
| 5,738,030 | A | | 4/1998 | Ok |
| 5,743,201 | A | | 4/1998 | Card et al. |
| 5,794,551 | A | | 8/1998 | Morrison et al. |
| 5,806,446 | A | | 9/1998 | Morrison et al. |
| 5,896,821 | A | | 4/1999 | Neely |
| 5,899,152 | A | | 5/1999 | Bardsley et al. |
| 5,979,344 | A | | 11/1999 | Christman, Jr. |
| 5,983,815 | A | | 11/1999 | Card |
| 6,009,818 | A | | 1/2000 | Cant et al. |
| 6,014,937 | A | | 1/2000 | Lovelady |
| 6,213,036 | B1 | | 4/2001 | Slattery |
| 6,228,460 | B1 | | 5/2001 | Hamilton et al. |
| 6,244,203 | B1 | | 6/2001 | Morgante et al. |
| 6,283,053 | B1 | | 9/2001 | Morgante et al. |
| 6,439,141 | B2 | | 8/2002 | Morgante et al. |
| 6,516,734 | B1 | | 2/2003 | Morgante et al. |
| 6,550,407 | B1 | | 4/2003 | Frost et al. |
| 6,807,917 | B1 | | 10/2004 | Christman et al. |
| 6,834,601 | B2 | | 12/2004 | Card et al. |
| 6,834,602 | B1 | | 12/2004 | Hall |
| 6,877,447 | B2 | | 4/2005 | Frost et al. |
| 6,877,449 | B2 | | 4/2005 | Morgante et al. |
| 6,886,477 | B2 | | 5/2005 | Vaughan et al. |
| 7,089,874 | B2 | | 8/2006 | Morgante et al. |
| 7,096,806 | B2 | | 8/2006 | Card et al. |
| 7,162,964 | B2 | | 1/2007 | Vaughan et al. |
| 7,216,598 | B1 | | 5/2007 | Christman, Jr. |
| 7,333,877 | B2 | | 2/2008 | Dabrowa et al. |
| 7,431,974 | B2 | | 10/2008 | Lovelady et al. |
| 7,438,007 | B1 | | 10/2008 | Hall |
| 7,481,172 | B2 | | 1/2009 | Vaughan |
| 7,490,566 | B2 | | 2/2009 | Hall |
| 7,634,326 | B2 | | 12/2009 | Christman, Jr. et al. |
| 7,685,952 | B2 | | 3/2010 | Frost et al. |
| 7,717,051 | B1 | | 5/2010 | Hall et al. |
| 7,739,970 | B2 | | 6/2010 | Hall |
| 7,905,187 | B2 | | 3/2011 | Card et al. |
| 7,946,233 | B2 | | 5/2011 | Hall et al. |
| 8,082,861 | B2 | | 12/2011 | Lovelady et al. |
| 8,127,698 | B1 | | 3/2012 | Ingram |
| 8,141,505 | B2 | | 3/2012 | Hall et al. |
| 8,141,506 | B2 | | 3/2012 | Hall et al. |
| 8,201,509 | B2 | | 6/2012 | Christman, Jr. |
| 8,240,263 | B1 | | 8/2012 | Frost et al. |
| 8,359,989 | B2 | | 1/2013 | Hall |
| 8,443,743 | B2 | | 5/2013 | Christman, Jr. |
| 8,776,703 | B2 | | 7/2014 | Hall et al. |
| 8,915,202 | B2 | | 12/2014 | Hall et al. |
| 9,909,254 | B2 | | 3/2018 | Hall |
| 2002/0037388 | A1 | | 3/2002 | Morgante et al. |
| 2007/0272137 | A1 | | 11/2007 | Christman et al. |
| 2008/0210146 | A1 | | 9/2008 | Hall |
| 2009/0056606 | A1 | | 3/2009 | Lovelady et al. |
| 2009/0260554 | A1 | | 10/2009 | Hall |
| 2018/0171546 | A1 | | 6/2018 | Hall |

FOREIGN PATENT DOCUMENTS

| | | |
|---|---|---|
| GB | 2 301 380 | 12/1996 |
| WO | WO 2006/075241 A1 | 7/2006 |

* cited by examiner

SYSTEM AND METHOD FOR FORMATION OF WOVEN STYLE TUFTED CUT/LOOP FABRICS

CROSS REFERENCE TO RELATED APPLICATIONS

The present patent application is a continuation of previously filed, co-pending U.S. patent application Ser. No. 15/897,396, filed Feb. 15, 2018, which is a continuation of previously filed, co-pending U.S. patent application Ser. No. 14/560,505, filed Dec. 4, 2014, which is a formalization of previously filed, U.S. Provisional Patent Application Ser. No. 61/912,209, filed Dec. 5, 2013, by the inventors named in the present application. This patent application claims the benefit of the filing date of the cited Provisional Patent Application according to the statutes and rules governing provisional patent applications, particularly 35 U.S.C. § 119(e), and 37 C.F.R. §§ 1.78(a)(3) and 1.78(a)(4). The specification and drawings of each of the above-referenced patent applications are specifically incorporated herein by reference as if set forth in their entireties.

FIELD OF THE INVENTION

The present invention generally relates to the formation of tufted fabrics such as carpets, and in particular to a system and method for forming patterned cut/loop tufted fabrics, carpets or other articles, which can be formed with a woven appearance.

BACKGROUND OF THE INVENTION

Patterned tufted articles such as carpets have long been in use in commercial and home settings. It further has been known to form such patterned tufted articles with a variety of different pattern effects, including the use of cut and/or loop pile tufts, the formation of varying pile heights, and the use of different color yarns to form multi-colored graphic and other pattern designs. As styles and consumer preferences have changed, it has been important that newer and wider varieties of patterned carpets be developed to meet market demands. For example, carpet patterns with floral or other varying, free flowing designs have become increasingly popular in recent years, and while more traditional, geometric designs or patterns remain in demand, consumers are also looking for crisper or cleaner appearances in such pattern designs, including more precision or definition, and/or textures, such as patterns with intermixed cut and loop pile tufts. Systems have been developed that enable the formation of tufted carpets having free flowing and/or geometric patterns or designs having enhanced precision and repeatability in the patterns. For example, U.S. Pat. Nos. 8,141,505 and 8,359,989, assigned to Card-Monroe Corp., disclose systems for forming tufted carpets that can include multiple different colors formed in a wide variety of designs or patterns, and with substantially enhanced precision and clarity. Such systems, while providing much greater precision and control and enabling a more expansive array of pattern designs to be tufted, can, however, be more expensive than standard cut pile, loop pile, and/or cut/loop pile tufting machines that can form conventional graphics and/or geometric style patterns, but which may be limited in the types, designs and precision of patterns being formed thereby.

It therefore can be seen that a need exists for a system and method for forming tufted articles, such as carpets, that addresses the foregoing and other related and unrelated problems in the art.

SUMMARY OF THE INVENTION

Briefly described, the present invention generally relates to a system and method for forming tufted fabrics or articles such as carpets, rugs and the like, having a generally woven appearance or style, and which can include cut pile and loop pile tufts of yarns intermixed within substantially the same longitudinal tuft rows. The system and method of the present invention can be operated to form such patterned tufted articles in a cost-effective manner while still enabling the formation of desired patterns with enhanced precision and clarity.

The system of the present invention generally will include a tufting machine having a tufting machine controller and a frame supporting a pair of longitudinally spaced first and second or front, upstream and rear, downstream needle bars, each of which includes a series of needles arranged at a desired gauge spacing mounted therealong. The needles can be arranged in in-line or offset rows. The needles of the front and rear needle bars further generally will be longitudinally spaced apart across the tufting zone of the tufting machine by a desired longitudinal spacing or stagger along upstream and downstream sides of the tufting zone. The needles are reciprocated into and out of a backing material being conveyed through the tufting zone, each carrying a yarn therewith for forming tufts of yarns in the backing material. The backing material generally will be fed through the tufting zone at a desired stitch rate under the control of backing feed rolls, which can be linked to the tufting machine controller.

The tufting machine further will include front and rear yarn feed mechanisms that feed a series of yarns to each of the needles of the needle bars. The yarn feed mechanisms utilized in the present invention generally can include standard straight yarn feed rolls driven by one or more motors and which feed the yarns to their associated needles. The yarn feed mechanisms thus do not require the use of pattern yarn feed attachments such as roll, scroll, single or double end yarn feed pattern attachments, and/or the use of tube banks, although the system and method of the present invention can be carried out utilizing tufting machines including such additional types of yarn feed pattern attachments. The front and rear yarn feed rolls can be controlled by the tufting machine control to slow or simply stop the yarn feed to the needles of the front and rear needle bars, respectively, at desired intervals during the formation of a tufted pattern, with patterning effects created by controlled shifting of the needles and utilizing a desired needle threading sequence for the different yarns used to form the tufted pattern.

A bed plate or rail further generally will be mounted to the frame on opposite sides of the tufting zone, defining a surface over which the backing material is fed. The bed plate can be adjustable so as to adjust the pile height of the tufts of yarns being formed in the backing material, and each section of the bed plate can include a needle plate having a series of reeds, fingers or wires arranged in spaced series along the width thereof, and which extend partially into and/or through the tufting zone. The fingers or wires of the needle plates will be arranged at selected spacings, defining a series of gaps through which the needles can pass as they are reciprocated into and out of the backing material.

A series of gauge parts are mounted beneath the tufting zone, with each of the gauge parts generally being reciprocated into engagement with one of the needles of the needle bars as the needles are reciprocated into and out of the backing material. In one embodiment, the gauge parts can include a series of loop pile loopers, typically mounted along the upstream side of the tufting zone, and a series of cut pile hooks mounted along the downstream or opposite side of the tufting zone, each of which will generally have a knife or cutting blade associated therewith. The cut pile hooks, and the loop pile loopers as needed or desired, further can be arranged at a different gauge spacing from their associated needles—e.g., the needles can be arranged at a first gauge spacing such as 1/16", 1/10", 5/32", etc. . . . gauge with the cut pile hooks and loop pile loopers accordingly arranged at a second gauge spacing, which can be a multiple of the needle gauge spacing, such as a double gauge spacing of 1/8", 1/5", 5/16", etc., or other increased gauge spacing. As the needles penetrate the backing material, the loop pile loopers and cut pile hooks will engage the needles, picking the yarns therefrom in order to form loop and/or cut pile tufts within the backing material.

In addition, a shift mechanism, such as a Smart Step™ shifter as manufactured by Card-Monroe Corp., will be connected to at one or both of the needle bars, typically at least the rear, or second needle bar, the needles of which are engaged by the cut pile hooks, although the first or upstream needle bar, whose needles are engaged by the loop pile loopers, also can be shifted. The needle bar(s) can be shifted as the tufted pattern is being formed to provide various graphic pattern effects, such as the formation of checkerboard type patterns of different colors and/or yarns arranged in the same longitudinal tuft rows, and/or other, different patterns.

In operation of the method of the present invention, as the backing material is fed through the tufting zone, the needles will be reciprocated into and out of the backing material, where they will be engaged by associated ones of the loop pile loopers and cut pile hooks to form loop and/or cut pile tufts. When only pile tufts are to be formed/shown at specific pattern fields or areas, the rear or second needle bar along the cut pile side of the tufting machine will be shiftable to an off-gauge position wherein the needles of the second or rear needle bar become misaligned with the cut pile hooks so as to prevent the pick-up of yarns from the needles by the cut pile hooks. At the same time, the yarn feed roll(s) feeding the yarns to such needles can be controlled to minimize the yarn feed such that the yarns on the cut pile side can float on the back or rear surface of the backing material. The yarn feed control further can be simplified by substantially stopping or starting the operation of the yarn feed rolls so that the yarn feed to the needles along the cut pile side can be run at approximately 100% feed rate or at a minimal feed amount or an approximately 0% feed rate, when the needles of the second needle bar are shifted to their on-gauge and off-gauge positions, respectively.

Similarly, when the cut pile tufts are to be formed/shown in the backing material, the yarn feed roll(s) feeding the yarns to the needles of the first or front needle bar which are engaged by the loop pile loopers for forming the loop pile tufts, can be controlled to cause the loops of yarns to be pulled low of the needle bar(s), including substantially stopping the yarn feed so that the loops are pulled out of the backing material and the yarns allowed to float on the rear surface of the backing material. As a result, enhanced, varying graphic patterns can be formed in the backing material with greater precision, including the formation of patterns having a woven appearance and which can include varying amounts of cut and loop pile tufts in the same pattern, using shift control without requiring use of expensive pattern attachments, and which patterns further are not limited by the longitudinal stagger between the needles of the first and second needle bars.

Various features, advantages and objects of the present invention will become apparent to those skilled in the art upon a review of the following detailed description, when taken in conjunction with the accompanying drawings.

Figure 1:
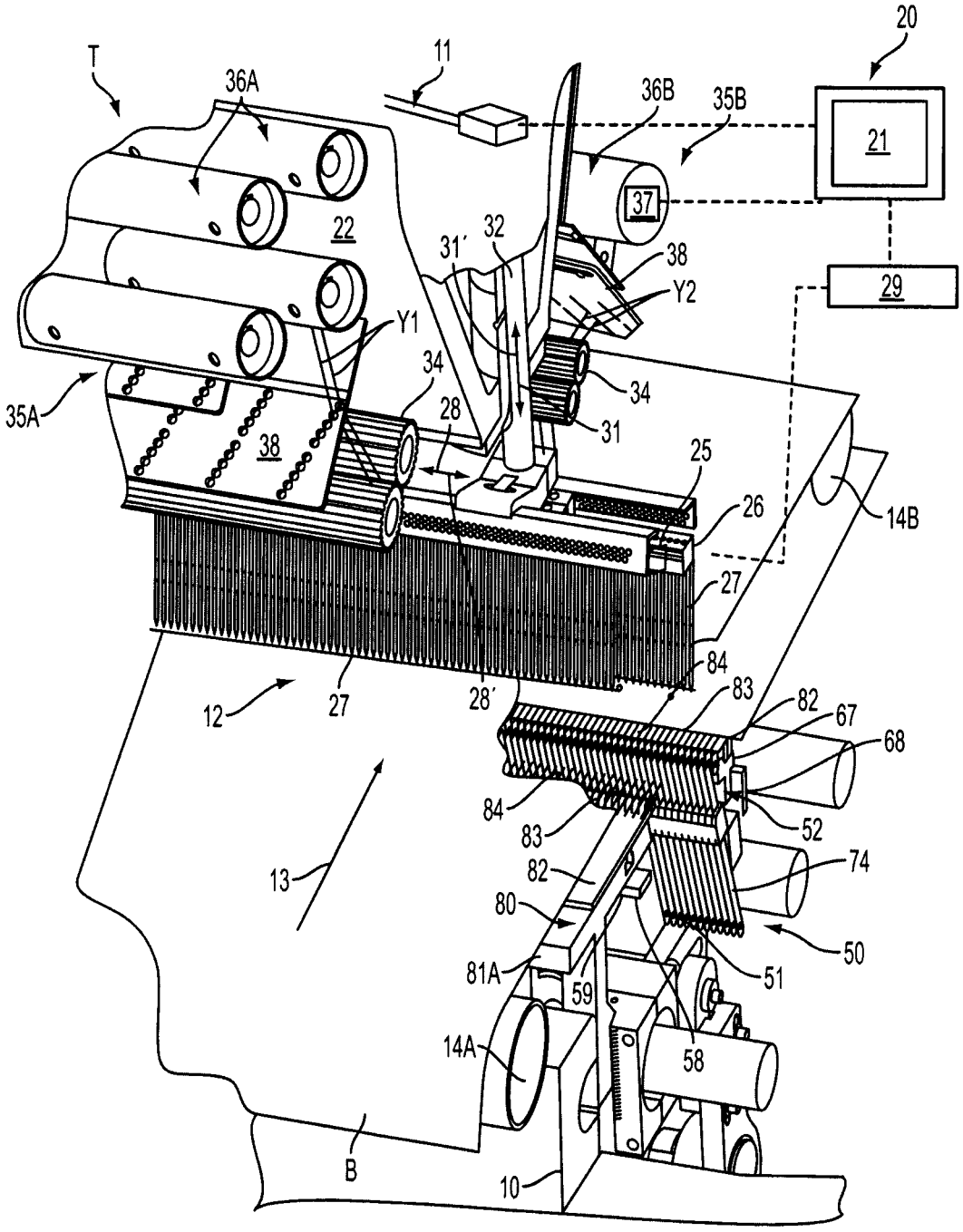
FIG. 1 is a perspective view of one embodiment of a tufting machine for forming woven style cut/loop tufted fabrics in accordance with the principles of the present invention.

The embodiments of the invention and the various features thereof are explained in detail below with reference to non-limiting embodiments and examples that are described and/or illustrated in the accompanying drawings. It should be noted that the features illustrated in the drawings are not necessarily drawn to scale, and features of one embodiment may be employed with other embodiments as the skilled artisan would recognize, even if not explicitly stated herein. Descriptions of certain components and processing techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law.

DETAILED DESCRIPTION OF THE INVENTION

Figure 2:
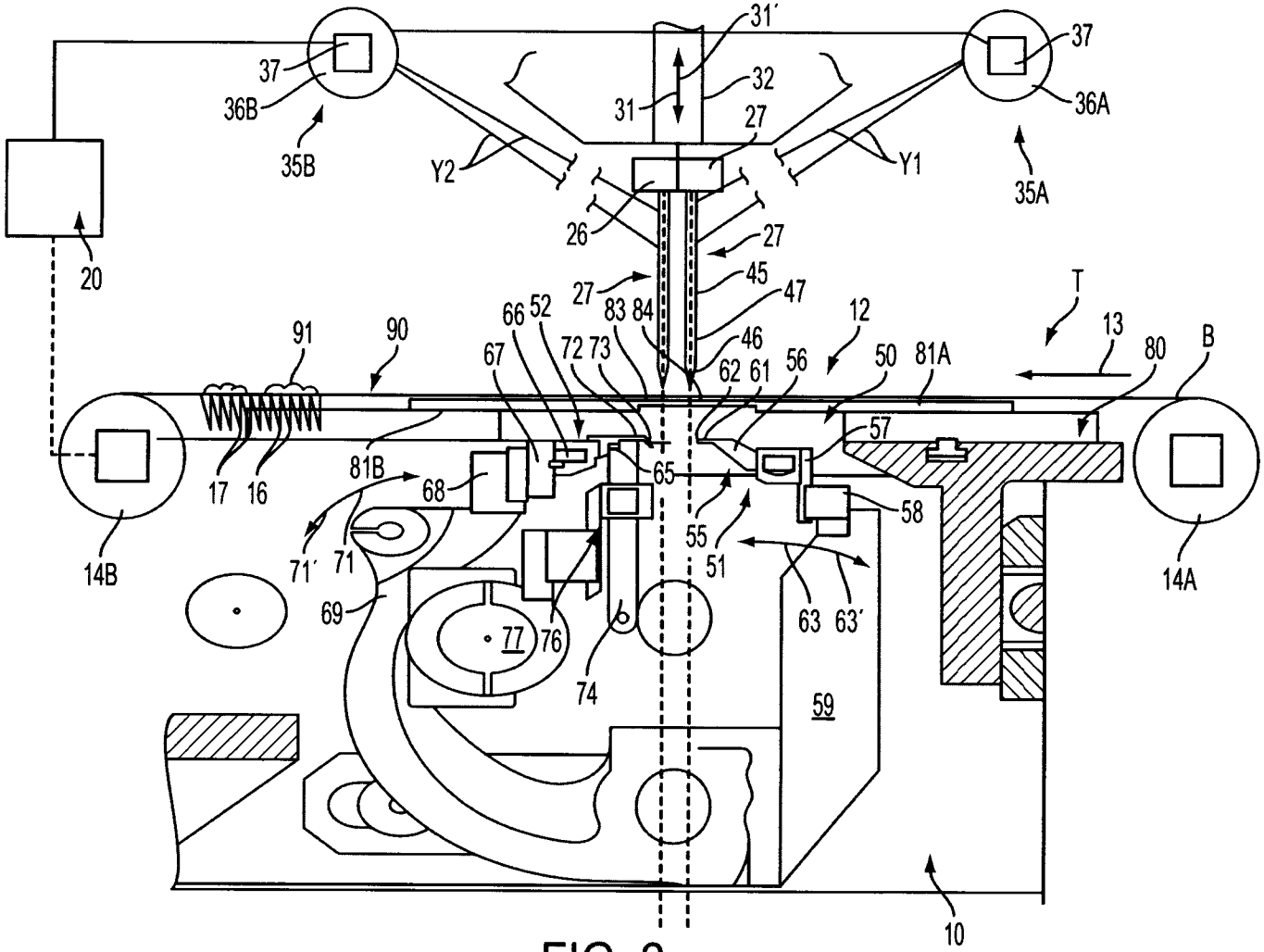
FIG. 2 is a side elevational view of the tufting machine of FIG. 1.
Figure 5A:
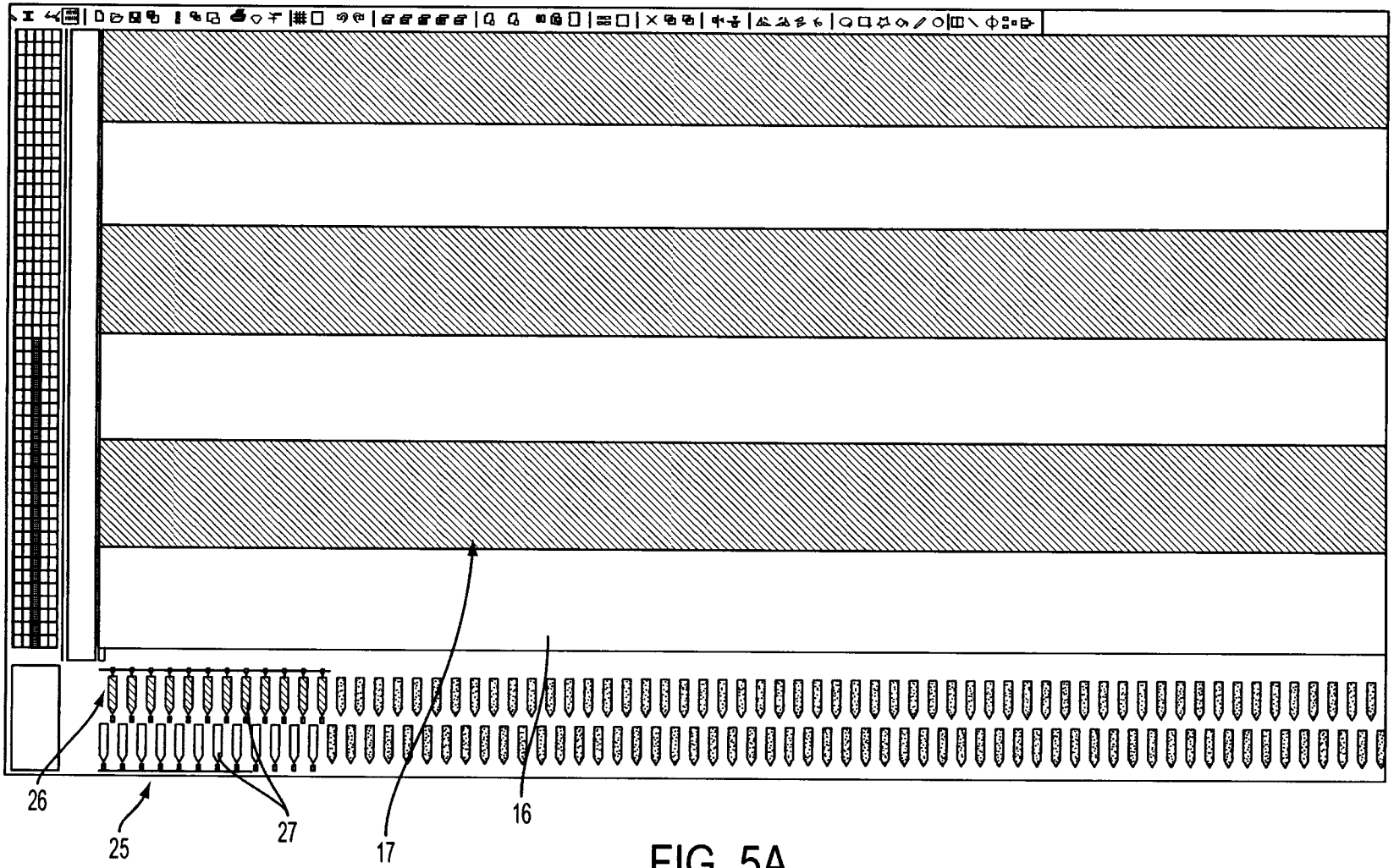
FIGS. 5A-5B show example tufted fabrics formed in accordance with the principles of the present invention, including examples of threading sequences therefor.
Figure 5B:
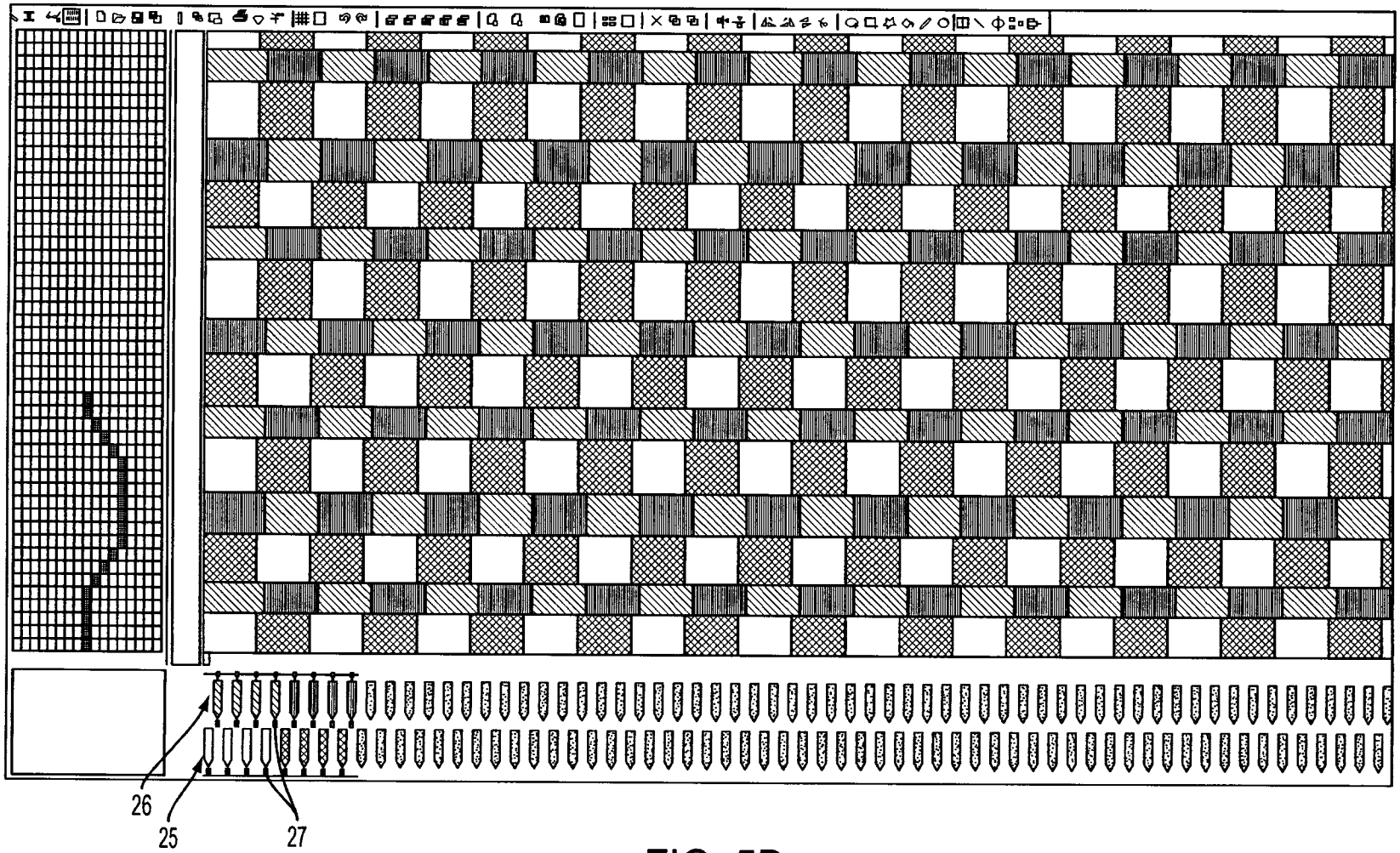

Referring now in greater detail to the drawings in which like numerals indicate like parts throughout the several views, the present invention is generally directed to a system and method for forming patterned fabrics or other articles such as carpets, and in particular relates to a system and method for forming tufted carpets having a woven style or appearance, including the use of loop pile tufts and cut pile tufts, which loop pile tufts and cut pile tufts further can be formed in the same longitudinal tuft rows, as illustrated in FIGS. 5A-5B. As illustrated in FIGS. 1 and 2, a tufting machine T formed and operating in accordance with the system and method of the present invention generally can comprise a Velva-loop or other cut/loop style tufting machine including a machine frame 10 supporting a main driveshaft 11 driven by a motor such as a variable speed servomotor or other similar drive. A tufting zone 12 is defined within the tufting machine through which a backing material B generally will be fed in the direction of arrow 13.

The backing material generally will be fed under the control of backing feed rolls 14A/14B in its feed direction indicated by arrow 13 through the tufting zone 12 for the introduction of a series of yarns Y1/Y2 for the formation of loop pile and cut pile tufts 16 and 17 (FIGS. 2 and 5A-5B) in the backing material B.

The tufting machine T can include tufting machine controller 20, such as a "Command Performance™" tufting machine computer control system as manufactured by Card-Monroe Corp. Such a tufting machine controller generally will include a computer controller or processor that can be programmed with pattern information for forming various desired patterns, and typically will include an operator interface 21, such as a touch screen as indicated in FIG. 1, although other types of interfaces including a keyboard and mouse, tablet or other similar input devices can be provided for enabling operator input and programming of the tufting machine controller 20. The tufting machine controller further can be connected to a separate pattern design center or via a network to a server or other control system, and/or can include pattern design functionality or capability so as to enable creation and programming of patterns directly therein. As schematically illustrated in FIGS. 1 and 2, the tufting machine controller 20 will be in communication with and can be programmed to control various operative features and elements of the tufting machine, including monitoring and controlling one or more motors driving the main driveshaft 11 of the tufting machine, as well as monitoring and controlling operation of the backing feed rolls 14A/B, shifting of needle bars, yarn feed and other operations of the tufting machine.

As illustrated in FIGS. 1 and 2, a pair of needle bars, including a first or upstream needle bar 25 and a second or downstream needle bar 26 will be located along opposite sides of the tufting zone 12. The needle bars 25 and 26 each carry a series of spaced needles 27 mounted in substantially in-line or staggered rows therealong, and with the needles being mounted at a first desired spacing, which can be based on a selected gauge spacing for the tufted pattern (for example, 1/8", 1/10", 5/32", 1/16", or other gauge spacing) as will be understood by those skilled in the art. The needles 27 of the first and second needle bars 25 and 26 also will be longitudinally spaced between the needles of the upstream and downstream needle bars from each other across the tufting zone by a desired stagger as further will be understood by those skilled in the art, which stagger between the needles of the upstream and downstream needle bars can be varied as needed to form different patterns.

In addition, at least one of the needle bars, i.e., at least the second and downstream needle bar 26, will be laterally shiftable in the direction of arrows 28/28' so as to move transversely across the tufting zone. As will also be understood, both needle bars can be shifted, or one of the needle bars, such as the first or upstream needle bar 25, can be operated without shifting. A shift mechanism 29 (FIG. 1) such as a cam shifter or "Smart Step™" shift control mechanism by Card-Monroe Corp. generally will be provided for each shifting needle bar and will be linked to the tufting machine controller 20. The shift mechanisms 29 for the needle bars 25 and 26 control the lateral shifting movement of the needle bars in the direction of arrows 28 and 28' so as to move the needles 27 carried by each shifting needle bar in a direction transverse to the direction of feed 13 of the backing material B in accordance with programmed pattern instructions.

As further indicated in FIGS. 1 and 2, the needles 27 of the first and second or upstream and downstream needle bars 25 and 26 each will receive and carry a series of yarns Y1 and Y2 into and out of the backing material as the needle bars are moved in the direction of arrows 31 and 31' in response to the operation of the main driveshaft driving a series of push rods 32 that support and carry the needle bars through a vertically reciprocating movement. The yarns will be fed to each of the needles via first and second yarn feed mechanisms 35A/B mounted on opposite sides (i.e., the front and rear) of the frame of the tufting machine T as indicated in FIGS. 1 and 2. The first and second yarn feed mechanisms 35A/B each generally will include one or more conventional, yarn feed rolls 36A/B operated under the control of one or more motors 37 controlled by the tufting machine controller 20 and configured to feed the yarns in a generally straight or direct feed operation. More complex and/or expensive yarn feed pattern attachments such as roll, scroll, single or double end pattern attachments are not required for the present invention. Thus, while such yarn feed pattern attachments can be used for controlling the feeding of the yarns to the needles in accordance with the system and method of the present invention, the present invention advantageously enables the use of standard straight yarn feed mechanisms rather than requiring more complex yarn feed pattern controls, thus enabling a reduction in cost of the tufting machine T.

The front and rear or first and second yarn feed rolls 36A/B on the opposite sides of the tufting machine feed the yarns Y1 and Y2 to the needles 27 of the first and second or front and rear needle bars 25 and 26, with the yarns typically passing through yarn guides 38 and puller rolls 39. The needles of the front and rear needle bars will be threaded with the various different color or type yarns in accordance with a threading sequence, such as indicated at 40 in FIGS. 5A-5B, based upon the desired pattern being formed. The yarns in each of the series of yarns Y1/Y2 can include varying color, type, size and/or texture to provide different desired pattern effects, and can be fed in a substantially straight yarn feed configuration from the standard yarn feed rolls 36A/B to each of the needles 27. For example, FIG. 5A shows a threading sequence with the front or upstream needles threaded with a first color, and the downstream needles with a second color, whereby alternating transverse rows or bands of different colors and/or cut or loop tufts, can be formed and with the fabric having a woven appearance. Alternatively, as shown in FIG. 5B, a series of different yarns can be used, for example, 4 colors of yarns, and with the needles of each needle bar threaded with selected color yarns in an alternating sequence, such as being arranged in pairs of needles carrying a desired color, to form a woven style or appearing fabric having a desired tufted pattern; for example, forming a multi-colored checker-board style pattern with alternating rows of different stitch lengths, as shown in FIG. 5B. The yarns will be carried with their respective needles into and out of the backing material during a tufting cycle with the feeding of the yarns and shifting of one or both of the needle bars controlled to form the desired loop and/or cut pile tufts in accordance with the programmed pattern, as indicated in FIGS. 2 and 5A-5B.

Figure 3:
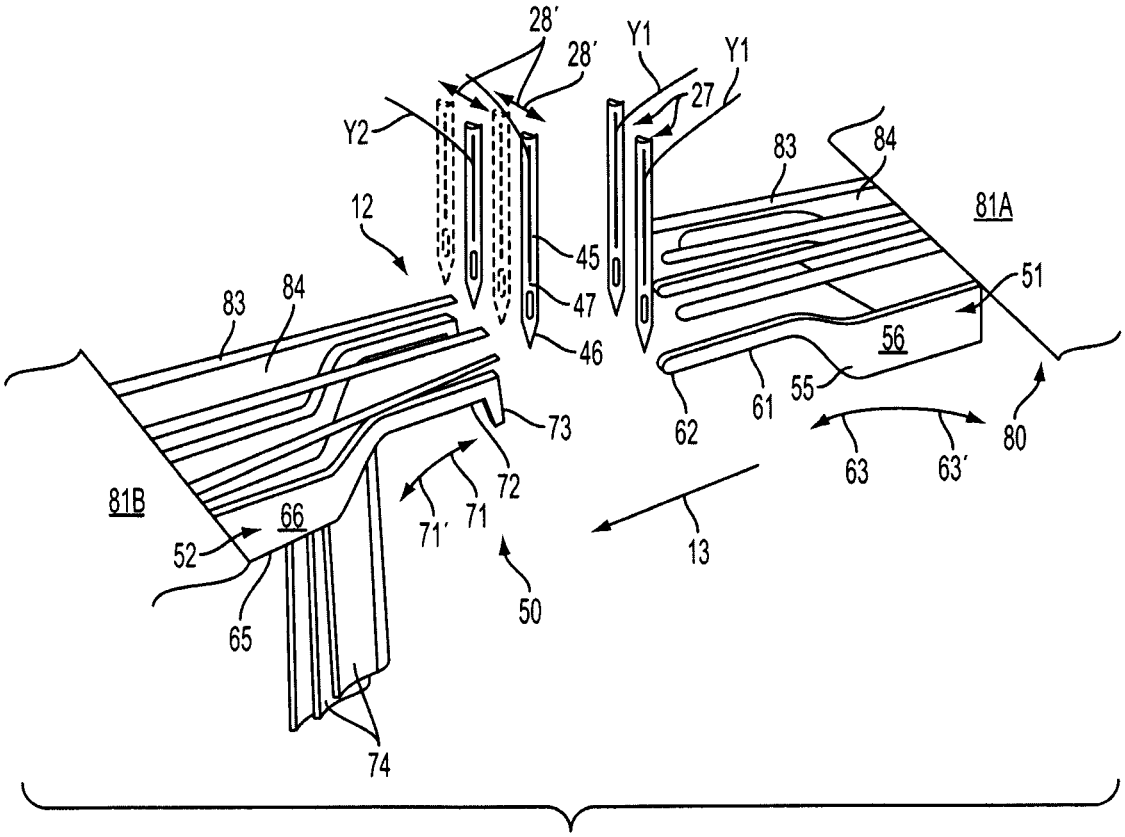
FIG. 3 is a perspective view of the tufting zone, illustrating shifting of the needles with respect to the cut pile hooks.

As generally illustrated in FIGS. 2 and 3, the needles 27 each generally will include an elongated shank 45 terminating at a pointed end 46 and having a takeoff area 47 adjacent the pointed end. As the needles penetrate the backing material, they can be engaged by a series of gauge parts 50 so as to pick and pull loops of yarns from the needles to form the tufts of yarns in the backing material. In one embodiment, as generally illustrated in FIGS. 1-4B, the gauge parts 50 will include loop pile loopers 51 mounted along the front or upstream side of the tufting zone (the loop pile side) for engaging the needles 27 of the upstream or first needle bar 25 to form loop pile tufts 16 (FIG. 2) in the backing material, and a series of cut pile hooks 52 that generally are mounted along the rear or downstream side of the tufting zone (the cut pile side) and are adapted to engage the needles 27 of the rear or second needle bar 26 for forming cut pile tufts 17 within the backing material.

Each of the loop pile loopers 51 generally will include an elongated body 55 having a shank 56 mounted within a holder or block 57, which in turn can be mounted on a looper bar 58 attached to a reciprocating arm 59. The body of each loop pile looper further will include a forwardly projecting throat 61 that extends toward the tufting zone and thus the needles from the shank, terminating in a pointed bill or frontal end 62. The loop pile loopers 51 will be reciprocated in the direction of arrows 63 and 63' toward and away from engagement with the needles of the upstream or first needle bar 25 as the needles have penetrated the backing material to a desired depth, so as to pick and pull loops of yarns therefrom for forming the loop pile tufts 16.

As also illustrated in FIG. 2, each of the cut pile hooks 52 generally will include a body 65 having a shank portion 66 mounted within a holder or block 67 carried by a hook bar 68 that is in turn mounted on a reciprocating arm 69 that carries the cut pile hooks in a reciprocating motion, as indicated by arrows 71 and 71' toward and away from engagement with the needles of the downstream or second needle bar 26. The cut pile hooks 52 further include an elongated throat 72 extending forwardly from the shank thereof and which throat terminates in a hooked bill or distal end 73. When the needles of the downstream needle bar 26 are engaged by the hooked bill of an associated or corresponding one cut pile hook, loops of yarns are picked therefrom and are captured along the throat portion of the cut pile hooks. A knife or cutting blade 74 is associated with each of the cut pile hooks, with each knife being mounted within a holder 76 attached to a reciprocating drive mechanism 77, which causes the knife blades to move into engagement with and cut any loops of yarns captured on their cut pile hooks to accordingly form the cut pile tufts within the backing material.

The cut pile hooks, and additionally the loop pile loopers as desired, can be arranged at a gauge spacing that is different from the first gauge spacing of the needles 27 arranged along the front and/or rear needle bars 25/26. In one embodiment, the cut pile hooks and loop pile loopers can be arranged at a second gauge spacing that is a multiple of the first gauge spacing of the needles, such as a double gauge spacing wherein the second gauge spacing between the cut pile hooks and loop pile loopers can be approximately double the first gauge spacing of the associated needles carried by the front and rear needle bars. For example, if the needles are arranged at a first gauge spacing of 1/16", the cut pile hooks and loop pile loopers can be arranged at a second gauge spacing of 1/8". Similarly, for gauge spacings of 1/8", 1/10", 5/32" for the needles, the cut pile hooks and loop pile loopers can be spaced at corresponding gauge spacings of 1/4", 1/5" and 5/16", respectively. Other, differing spacings, for example spacings that are greater than the spacings between the needles, also can be provided.

As further illustrated in FIGS. 1-2, the tufting machine T also generally will include a bed plate or bed rail 80, which can be adjusted vertically so as to enable adjustments of pile heights being formed, and which generally will include upstream and downstream sections or portions 81A/B on opposite sides of the tufting zone T. Each of the bed plate sections 81A/81B further will include a needle plate 82 that can include a series of fingers, wires or reeds 83 (FIGS. 1 and 3-4B). The fingers or wires will be spaced apart at a spacing, which can be similar to or can be a multiple of the first and/or second gauge spacings of the needles and the gauge parts, so as to define gaps 84 therebetween, through which the needles pass for engagement with their associated gauge parts below the tufting zone, as indicated in FIGS. 3-4B.

In operation of the tufting machine T (FIGS. 1-2) in accordance with the principles of the present invention, as the backing material B is fed through the tufting zone in the direction of arrow 13, the needles of the front and rear needle bars will be reciprocated into and out of the backing material as will be understood by those skilled in the art. The needles of each needle bar 25/26 generally will be threaded with yarns of a desired color, type, etc., in accordance with a threading sequence corresponding to the desired pattern appearance or layout, as shown in FIGS. 5A-5B; and with the yarns being fed to the needles of each needle bar from the upstream and downstream yarn feed rolls 36A/36B (FIGS. 1-2) at a desired rate to form loop and/or cut pile tufts to be shown in the pattern at the desired pile height therefor.

Figure 4A:
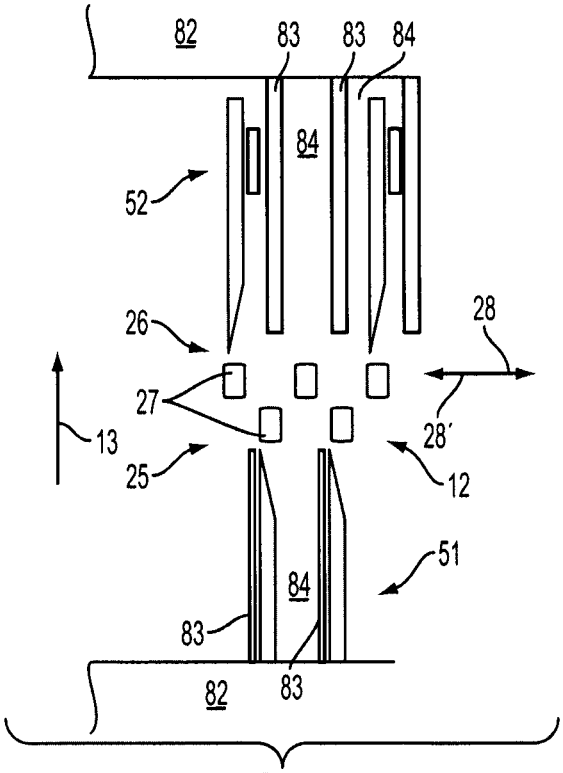
FIGS. 4A-4B are plan views illustrating the shifting of the needles in accordance with the principles of the present invention.
Figure 4B:
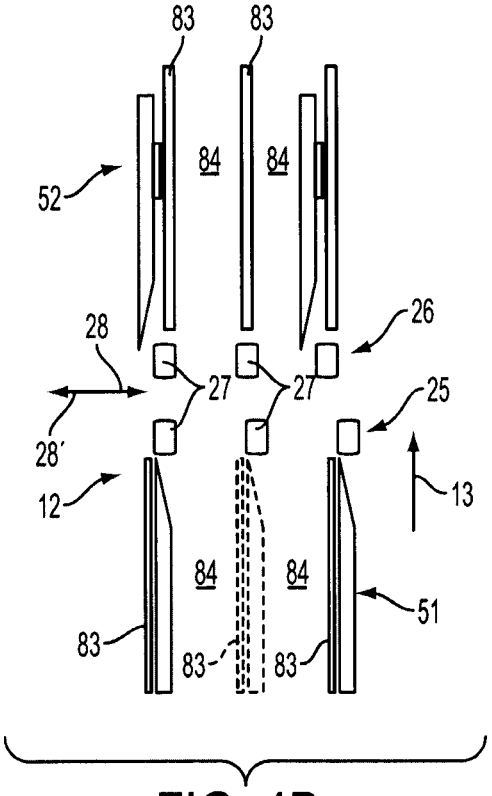

For the portions of the pattern being formed wherein loop pile tufts are to be retained or shown, the rear or second needle bar 26, along the cut pile side of the tufting zone, can be shifted in a direction transverse to the feeding of the backing materials by an amount sufficient to move the needles from an on-gauge position as shown in FIG. 4A, wherein the needles 27 of the second or rear needle bar 26 are aligned with corresponding ones of the cut pile hooks 52 for engagement and picking of yarns Y2 therefrom, into an off-gauge position, shown in FIG. 4B, wherein the needles are shifted in the direction of arrows 28 to a position such that the needles 27 of the second or rear needle bar 26 become substantially offset or misaligned with the cut pile hooks 52 sufficient to avoid their being engaged by a corresponding one of the cut pile hooks.

Typically, to move the needles to their off-gauge position, the needle bar will be shifted a distance that is less than the second gauge spacing between the cut pile hooks. In one embodiment illustrated in FIGS. 4A-4B, this shift distance can be approximately half of the gauge spacing between the cut pile hooks, for example, being approximately equal to the first gauge spacing of the needles where the second gauge spacing of the gauge parts are at a double or other increased gauge spacing versus the first gauge spacing of the needles. Other shifting distances, which are greater or less than the first gauge spacing of the needles also can be used. As a result, the cut pile hooks will be substantially prevented from engaging and picking the yarns Y2 from the misaligned needles of the second needle bar. As also indicated in one embodiment shown in FIG. 4B, the needles 27 of the second or rear needle bar 26 further can be shifted into positions generally aligned with a wire or finger 82 of the downstream needle plate 81B, or to any other position in which the needles will be located and/or maintained out of alignment with corresponding ones of the cut pile hooks sufficient to substantially prevent pick-up of the yarns therefrom by the cut pile hooks.

With the needles shifted to their off-gauge or misaligned position, the rear or second yarn feed roll 36B feeding the yarns Y2 to the needles of the second or rear needle bar will be controlled by being slowed to a substantially minimal amount or stopped (i.e., run at approximately a 0% or other minimized feed rate), so that as the needles 27 of the second or rear needle bar 26 along the cut pile side of the tufting zone are reciprocated out of the backing material, the yarns Y2 carried with these needles remain therewith, without loops of these yarns being picked and/or formed or captured by the cut pile hooks. With the formation of cut pile tufts thus substantially being prevented, the first or front yarn feed roll 36A on the upstream or front side (the loop pile side) of the tufting machine, which is feeding the yarns Y1 to the needles of the first or front needle bar 25 can be operated at a substantially full feed rate (i.e., fed at an approximately 100% feed rate) or controlled to feed its yarns at any other desired feed rate as needed to form loop pile tufts of a desired pile height. The first or front needle bar 25 also can be shifted laterally across the backing material as needed to place loop pile tufts of different color, texture or type yarns in different areas of the pattern, as indicated in FIG. 5.

As a result, with the feeding of the yarns Y2 to the needles of the second or rear needle bar being substantially minimized or stopped, only the loop pile tufts being formed will show along the front surface of the backing material, without the danger of overtufting or previously formed loops of yarns engaged by the cut pile hooks being shown. Instead, as the backing material is indexed further forwardly, the feeding of the yarns Y2 is substantially stopped or minimized to an extent that the yarns Y2 are allowed to substantially float on the rear or back surface 90 of the backing material B, as indicated by back stitches 91 in FIG. 2. This can further lead to a conservation of yarns in the patterns being formed.

Upon reaching a pattern step wherein cut pile tufts are to be formed in the backing material, the second, rear or downstream side yarn feed roll 36B for the yarns Y2 (FIG. 2) being fed to the needles of the second or rear needle bar 26 (along the cut pile side of the tufting zone) will be reengaged and can be run at a substantially full or other desired rate (i.e., the yarns Y2 can be fed to the needles at up to an approximately 100% feed rate). The rear needle bar 26 further will be shifted in the direction of arrow 28' (FIG. 4A) so that its needles will be moved back into an on-gauge position whereby the needles 27 will be aligned with corresponding ones of the cut pile hooks 52. As a result, engagement of the needles of the second or rear needle bar by the cut pile hooks is enabled for the formation of cut pile tufts, which cut pile tufts can be formed in the same longitudinal tuft rows as loop pile tufts 16, as indicated in FIG. 5.

As the cut pile tufts are formed, the first, front or upstream side yarn feed roll 36A feeding the yarns Y1 to the needles 27 of the first or front needle bar 25 (along the loop pile side of the tufting zone) can be substantially slowed to a minimum feed rate or stopped (i.e., fed at an approximately 0% or other minimal feed rate) to cause the yarns Y1 carried by the needles of the first or front needle bar to be substantially withdrawn from the backing material, including being pulled low to an extent sufficient to be hidden or buried among the higher tufts formed in the backing material, or potentially be pulled out of and allowed to float along the rear surface of the backing material while the cut pile tufts are being formed in the backing material. The front needle bar 25 additionally can be shifted so that its needles are moved to an off-gauge position (as shown at dashed lines in FIG. 4B) to prevent engagement of the needles by the loop pile loopers and thus avoid the pick-up and formation of loops of yarns on the loop pile loopers arranged therebelow, as needed/desired.

Accordingly, the method of the present invention enables the formation of cut and loop patterns with the formation of a wide variety of differing amounts of cut and loop tufts being formed in the same fabric and/or in the same longitudinal tuft rows without being limited by the stagger between the needles of the front and rear needle bars. Since the formation and/or location of the cut and loop tufts is not dependent on the stagger between the needles of the needle bars, the present method further provides additional flexibility in the patterning of cut and loop tufts within the same longitudinal tuft rows, for example enabling the formation of varying graphic and/or geometric pattern designs by controlling the shifting of one or both needle bars and a simplified control of the yarn feed (i.e., a substantially on/off feed control), without requiring additional yarn feed pattern attachments. The present invention further is capable of utilizing a standard straight yarn feed for forming both loop pile and cut pile tufts, each of which yarn feeds can be run at a high or low rate, including being fed at substantially a full or 100% feed rate, or can be substantially minimized, including being stopped or run at an approximately 0% feed rate. The resultant tufted fabrics thus can have a 100% surface density appearance while sewing only one-half the yarns being fed to the needles, with the remaining yarns being permitted to float along the rear surface of the backing material. The present invention thus enables selective sewing of desired amounts of cut pile and loop pile tufts, including running sections of substantially all cut pile tufts or substantially all loop pile tufts to form various patterned tufted articles having both loop and cut pile tufts in the same longitudinal tuft rows and a substantially woven appearance without substantially limiting the pattern and the formation of the loop pile and cut pile tufts based on the selected stagger between the needle bars.

It further will be understood that the invention is not limited to the particular methodology, devices, apparatus, materials, applications, etc., described herein, as these may vary. It is also to be understood that the terminology used herein is used for the purpose of describing particular embodiments only, and is not intended to limit the scope of the invention. It must be noted that as used herein and in the appended claims, the singular forms "a," "an," and "the" include plural references unless the context clearly dictates otherwise.

Unless defined otherwise, all technical and scientific terms used herein have the same meanings as commonly understood by one of ordinary skill in the art in the field to which this invention is directed, and it will be understood that any methods and materials similar or equivalent to those described herein can be used in the practice or construction of the invention.

The foregoing description generally illustrates and describes various embodiments of the present invention. It will, however, be understood by those skilled in the art that various changes and modifications can be made to the above-discussed construction of the present invention without departing from the spirit and scope of the invention as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of the present invention. Accordingly, various features and characteristics of the present invention as discussed herein may be selectively interchanged and applied to other illustrated and non-illustrated embodiments of the invention, and numerous variations, modifications, and additions further can be made thereto without departing from the spirit and scope of the present invention as set forth in the appended claims.

The invention claimed is:

1. A method of forming a patterned tufted article, comprising:

moving a backing material through a tufting zone;

reciprocating a first needle bar and a second needle bar, each carrying a series of spaced needles, into and out of the backing material;

feeding a series of yarns to the needles of the first and second needle bars as the needle bars are reciprocated to deliver the yarns into the backing material;

as the needles are reciprocated into and out of the backing material, engaging the needles with a series of gauge parts and forming tufts of yarns in the backing material;

shifting at least one needle bar of the first and second needle bars by an amount sufficient to move the needles carried thereby to an off-gauge position sufficient to be substantially aligned with gaps between corresponding ones of the gauge parts so as to substantially avoid pick-up of yarns carried by the needles of the at least one needle bar shifted to the off-gauge position; and controlling the feeding of yarns to the needles of the at least one needle bar shifted to the off-gauge position such that the yarns carried thereby are substantially maintained with the needles of the at least one needle bar as the needles of the at least one needle bar are reciprocated into and out of the backing material.

2. The method of claim 1, wherein controlling the feeding of the yarns to the at least one needle bar comprises substantially minimizing the feeding of the yarns to the needles of the at least one needle bar when the needles of the at least one needle bar are shifted to their off-gauge position such that the yarns are substantially retracted from the backing with the reciprocation of the needles out of the backing.

3. The method of claim 1, wherein shifting the at least one needle bar comprises shifting the needle bar by approximately one-half of a gauge spacing between the gauge parts.

4. The method of claim 1, wherein engaging the needles with a series of gauge parts comprises engaging the needles of the first needle bar with a series of loop pile loopers to form loop pile tufts in the backing material and engaging the needles of the second needle bar with a series of cut pile hooks to form cut pile tufts in the backing material.

5. The method of claim 4, wherein shifting at least one needle bar to an off-gauge position comprises shifting the second needle bar to a position wherein at least a portion of the needles carried thereby are substantially prevented from being engaged by the cut pile hooks.

6. The method of claim 5, wherein controlling the feeding of the yarns to the needles of the at least one needle bar comprises substantially minimizing the feeding of the yarns to the needles of the second needle bar when the second needle bar is shifted to its off-gauge position such that the yarns fed to the needles of the second needle bar are substantially removed from the backing material and enabled to float on a rear side of the backing material.

7. The method of claim 4, wherein shifting at least one needle bar to an off-gauge position comprising shifting the first needle bar to a position wherein at least a portion of the needles carried by the first needle bar are moved substantially out of alignment with the loop pile loopers to avoid engagement thereby.

8. The method of claim 1, further comprising controlling the feeding of the yarns to the needles of another needle bar of the first and second needle bars to selectively remove loops of yarns from the backing material.

9. The method of claim 1, further comprising arranging the needles of the at least one needle bar at a first gauge spacing, and arranging the gauge parts engaging the needles of the at least one needle bar at a second, different gauge spacing.

10. A tufting machine, comprising:

a first needle bar carrying a first series of needles, and a second needle bar spaced from the first needle bar and carrying a second series of needles;

backing feed rolls feeding a backing material along a path of travel though the tufting machine, wherein the needles of the first and second needle bars are reciprocated into and out of the backing material as the backing material passes therebeneath;

at least one shifter connected to at least one of the first and second needle bars and configured to shifting the at least one of the first and second needle bars transversely with respect to the backing material passing therebeneath;

first and second yarn feed mechanisms mounted on opposite sides of the tufting machine, the yarn feed mechanisms feeding yarns to selected ones the needles of the first and second series of needles carried by the first and second needle bars; and a series of gauge parts mounted below the backing material and reciprocated into engagement with the first and second series of needles of the first and second needle bars when the first and second series of needles are reciprocated into the backing material for pick-up of yarns carried by the needles;

wherein the gauge parts are spaced apart so as to define a series of gaps therebetween, and wherein the shifter is operable to shift the at least one of the first and second needle bars by a distance sufficient to shift the first or second series of needles carried thereby to an off-gauge position whereby the shifted first or second series of needles are substantially aligned with the gaps defined between associated ones of the gauge parts located below the shifted first or second series of needles sufficient to substantially avoid engagement and pick-up of the yarns from the shifted first or second series of needles by the associated ones of the gauge parts.

11. The tufting machine of claim 10, wherein the gauge parts comprise a plurality of cut pile hooks located along a downstream side of the tufting zone and adapted to engage the second series of needles carried by the second needle bar to form cut pile tufts in the backing material, and a plurality of loop pile loopers located along an upstream side of the tufting zone and adapted to engage the first series of needles carried by the first needle bar to form loop pile tufts in the backing material.

12. The tufting machine of claim 11, wherein the first and second series of needles are arranged along the first and second needle bars at a first gauge spacing and the cut pile hooks are spaced at a second gauge spacing that is a multiple of the first gauge spacing.

13. The tufting machine of claim 12, wherein the second gauge spacing between the cut pile hooks is approximately twice the first gauge spacing between the second series of needles of the second needle bar.

14. The tufting machine of claim 12, wherein the second spacing between the gauge parts is at least 1.5 times the first spacing between the first and second series of needles of the first and second needle bars, and the gauge parts comprise a series of cut pile hooks arranged below the needles of the second needle bar, and a series of loop pile loopers arranged below the needles of the first needle bar.

15. A tufted carpet having cut and loop pile tufts formed according to the method of claim 1.

* * * * *